US005241760A

United States Patent [19]

Wedel

[11] Patent Number: 5,241,760

[45] Date of Patent: * Sep. 7, 1993

[54] DRYER APPARATUS

[75] Inventor: Gregory L. Wedel, Beloit, Wis.

[73] Assignee: Beloit Technologies, Inc., Wilmington, Del.

[ * ] Notice: The portion of the term of this patent subsequent to Jun. 19, 2007 has been disclaimed.

[21] Appl. No.: 606,654

[22] Filed: Oct. 31, 1990

Related U.S. Application Data

[63] Continuation-in-part of Ser. No. 431,961, Nov. 3, 1989, Pat. No. 5,101,577, which is a continuation-in-part of Ser. No. 14,569, Feb. 13, 1987, Pat. No. 4,934,067.

[51] Int. Cl.[5] ..... F26B 5/00

[52] U.S. Cl. ..... 34/115; 34/117

[58] Field of Search ..... 34/116, 117, 16, 23, 34/54, 114, 115

[56] References Cited

U.S. PATENT DOCUMENTS

| | | | |
|---|---|---|---|
| 3,250,019 | 5/1966 | Beachler | 34/117 |
| 3,868,780 | 3/1975 | Soininen et al. | 34/116 |
| 3,874,997 | 4/1975 | Kankaanpää | 162/290 |
| 4,359,827 | 11/1982 | Thomas | 34/116 |
| 4,677,762 | 7/1987 | Futcher | 34/117 |
| 4,744,156 | 5/1988 | Futcher | 34/114 |
| 4,882,854 | 11/1989 | Wedel et al. | 34/115 |
| 5,022,163 | 6/1991 | Ilvespaa et al. | 34/117 |

FOREIGN PATENT DOCUMENTS

| | | |
|---|---|---|
| 254666 | 1/1988 | European Pat. Off. . |
| 332599 | 9/1989 | European Pat. Off. . |
| 426607 | 5/1991 | European Pat. Off. . |
| 432571 | 6/1991 | European Pat. Off. . |
| 2212209 | 9/1973 | Fed. Rep. of Germany . |
| 9001209 | 5/1990 | Fed. Rep. of Germany . |
| 8202937 | 9/1982 | PCT Int'l Appl. . |
| 8806205 | 8/1988 | PCT Int'l Appl. . |
| 8808898 | 11/1988 | PCT Int'l Appl. . |
| 9004065 | 4/1990 | PCT Int'l Appl. . |

*Primary Examiner*—Henry A. Bennett

*Attorney, Agent, or Firm*—Dirk J. Veneman; Raymond W. Campbell; David J. Archer

[57] ABSTRACT

A dryer apparatus is disclosed for drying a pressed web. The apparatus includes a plurality of single tier dryer sections in which successive sections dry alternate sides of the web, the web being transferred between successive sections without any open draw of the web such that the web is uniformly dried on both sides thereof while the web is restrained against cross-machine directional shrinkage. Each of the sections includes a single tier of dryers with an intermediate roll disposed between each adjacent dryer. A dryer felt extends in serpentine configuration around each dryer and roll such that the web is disposed between the felt and each dryer for drying one side of the web. The felt is also disposed between the roll and the web with the felt in direct contact with an alternate side of the web. The intermediate roll defines a plurality of circumferential grooves for diffusing boundary air following the felt that would otherwise tend to lift the web from the felt extending around the roll. The arrangement is such that inherent machine directional shrinkage of the web during drying thereof inhibits crossmachine directional shrinkage of the web during movement of the web between successive dryers.

3 Claims, 2 Drawing Sheets

DRYER APPARATUS

CROSS-REFERENCE TO RELATED APPLICATIONS

The subject application is a continuation-in-part of co-pending patent application Ser. No. 07/431,961 filed Nov. 3, 1989 now U.S. Pat. No. 5,101,577, which is a continuation-in-part of Ser. No. 07/014,569 filed Feb. 13, 1987, which issued as U.S. Pat. No. 4,934,067 Jun. 19, 1990. All the subject matter of Ser. Nos. 07/431,961 and 07/014,569 are incorporated herein by reference.

BACKGROUND OF THE INVENTION

1. Field of the Invention

The present invention relates to a dryer apparatus for drying a pressed web. More specifically, the present invention relates to a dryer apparatus which includes a plurality of single tier dryer sections in which successive sections dry alternate sides of the web as the web is transferred between successive sections without any open draw.

2. Information Disclosure Statement

In the papermaking art, a formed web of paper is pressed in a press section in order to remove as much water as possible from the formed web. Subsequently, the pressed web is guided around a plurality of heated drying cylinders in order to remove remaining water from the web.

Preferably, alternate sides of the web are successively brought into direct contact with the heated surfaces of the drying cylinders as the web moves through the dryer apparatus. Such successive drying of alternate sides of the web tends to enhance the uniform drying characteristics of the resultant dried roll.

U.S. Pat. No. 4,934,067 to Skaugen et al teaches the aforementioned drying apparatus which also permits transfer of the web between successive drying sections without open draw of the web. Consequently, the apparatus disclosed in U.S. Pat. No. 4,934,067 enables the restrained drying of the web not only in the wet section of the dryer apparatus, but along the entire length of the dryer apparatus.

More particularly, because the web is constrained by the dryer felt during transit of the web around the dryer and because vacuum is applied to hold the web on the felt during movement around an intermediate roll, cross-machine directional shrinkage of the web during drying is inhibited.

Also, during the transfer of the web between successive dryer sections, vacuum means is used to restrain the web against such cross-machine directional shrinkage and to prevent cross-machine directional shrinkage that would occur in such a transfer if an open draw transfer were utilized.

Therefore, the aforementioned disclosure of U.S. Pat. No. 4,934,067 not only enabled enhanced runnability, but also provided improved resultant sheet quality because due to the sheet being restrained against cross-machine directional shrinkage, edge curl of the web was inhibited.

However, in certain applications, it has been discovered that the provision of intermediate vacuum rolls and the like are unnecessary provided means are supplied for diffusing boundary air following the felt adjacent to such intermediate rolls.

More particularly, the present invention provides a dryer apparatus having a plurality of single tier dryer sections in which successive sections dry alternate sides of the web, the web being transferred between successive sections without any open draw, and in which the web is guided between adjacent dryers by an intermediate roll defining a plurality of circumferential grooves for diffusing the aforementioned boundary air.

Therefore, it is a primary objective of the present invention to provide a dryer apparatus which provides a significant contribution to the art of drying a pressed web.

Another object of the present invention is the provision of a dryer apparatus including an intermediate roll which defines a plurality of circumferential grooves for diffusing boundary air following a dryer felt that would otherwise tend to lift the web from the felt extending around the intermediate roll.

Another object of the present invention is the provision of a dryer apparatus having an intermediate roll defining a plurality of grooves such that inherent machine directional shrinkage of the web during drying thereof inhibits cross-machine directional shrinkage of the web during movement of the web between successive dryers.

Another object of the present invention is the provision of a dryer apparatus in which each intermediate roll has a diameter which is substantially less than the diameter of adjacent dryers such that the machine directional shrinkage increases the tension of the web between successive dryers so that the pressure exerted by the web against the dryer felt during movement of the web around the intermediate roll is increased in conformity with an equation $PS=TW/RI$, where PS is the pressure exerted by the web on the felt, TW is the machine direction tension of the web, and RI is the radius of the intermediate roll.

Other objects and advantages of the present invention will be readily apparent to those skilled in the art by a consideration of the detailed description contained hereinafter taken in conjunction with the annexed drawings.

SUMMARY OF THE INVENTION

A dryer apparatus is disclosed for drying a pressed web. The apparatus includes a plurality of single tier dryer sections in which successive sections dry alternate sides of the web. The web is transferred between successive sections without any open draw of the web such that the web is uniformly dried on both sides thereof while the web is restrained against cross-machine directional shrinkage.

Each of the dryer sections includes a single tier of dryers. An intermediate roll is disposed between each adjacent dryer of the single tier dryers. A dryer felt extends in serpentine configuration around each dryer and intermediate roll such that the web is disposed between the felt and each dryer of the single tier of dryers for drying one side of the web. Also, the felt is disposed between the intermediate roll and the web so that the felt is disposed in direct contact with an alternate side of the web.

The intermediate roll defines a plurality of circumferential grooves for diffusing boundary air following the felt that would otherwise tend to lift the web from the felt extending around the intermediate roll.

The arrangement is such that inherent machine directional shrinkage of the web during drying thereof inhibits cross-machine directional shrinkage of the web during movement of the web between successive dryers.

In a more specific embodiment of the present invention, the dryer apparatus includes a first single tier dryer section for drying one side of the web. A second single tier dryer section is disposed immediately downstream relative to the first dryer section for drying an alternate side of the web.

A transfer means is disposed between the first and second dryer sections for transferring the web without open draw between the first and the second dryer sections.

The transfer means includes a felt roll which is disposed between the first and the second dryer sections such that the dryer felt extends from the first dryer section to and around the felt roll. The felt is disposed between the felt roll and the web.

A further felt roll is disposed between the felt roll and the first dryer section, and a further felt extends around the further felt roll such that the further felt is disposed between the further felt roll and the web. The further felt thereafter extends around the second dryer section so that the web disposed between the felt and the further felt is guided without open draw from the first to the second dryer section.

Means are disposed adjacent to the felt roll for urging the web to follow the further felt when the felt and the further felt diverge relative to each other adjacent to the felt roll.

More specifically, the means is a blow box disposed on the opposite side of the second felt relative to the web. The blow box is connected to a source of pressurized air such that a curtain of air is blown from the blow box onto the further felt so that the web is drawn towards the further felt due to a Coanda effect of the curtain of air relative to the further felt.

Each of the intermediate rolls has a diameter which is substantially less than the diameter of the adjacent dryers such that the machine directional shrinkage increases the tension of the web between successive dryers. The arrangement is such that the pressure exerted by the web against the dryer felt during movement of the web around the intermediate roll is increased in conformity with the equation $PS=TW/RI$ pounds per square inch, where PS is the pressure exerted by the web on the dryer felt extending around the intermediate roll, TW is the machine direction tension of the web induced by the machine directional shrinkage of the web during drying, and RI is the radius of the intermediate roll.

In a preferred embodiment of the present invention, the plurality of grooves are spaced in a cross-machine direction along the entire length of the intermediate roll.

Each groove of the plurality of circumferential grooves extends around the circumference of the intermediate roll so that air pumped into each groove by the dryer felt converging relative to the intermediate roll flows through and around each groove so that a build-up of air pressure at a converging nip defined between the dryer felt and the intermediate roll is inhibited.

In an alternative embodiment of the present invention, the dryer apparatus includes a vacuum box which is disposed closely adjacent to an unfelted end portion of the intermediate roll. The vacuum box is selectively connected to a source of partial vacuum such that in use of the apparatus, during a tail threading operation thereof, the vacuum box is connected to the source of partial vacuum such that air flows in a direction from a tail of the web towards and through the dryer felt and into the circumferential grooves disposed adjacent to the vacuum box and into the vacuum box such that the tail is urged into close conformity with the dryer felt moving around the intermediate roll during the tail threading operation.

In one embodiment of the present invention, the intermediate roll is a shell roll, the shell defining a plurality of circumferential grooves.

More specifically, the shell roll includes a rotatable shell and an internal baffle disposed within the shell. The shell and baffle define a tail threading chamber which is disposed adjacent to one end of the intermediate roll.

Circumferential grooves disposed in the vicinity of the tail threading chamber define aperture means such that the tail threading chamber is disposed in fluid communication with the circumferential grooves disposed in the vicinity of the chamber such that when the tail threading chamber is connected to a source of partial vacuum, air flows from a tail of the web towards and through the dryer felt, through the grooves disposed in the vicinity of the threading chamber, and through the aperture means into the threading chamber so that the tail is urged into close conformity with the dryer felt during a tail threading operation of the dryer apparatus.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
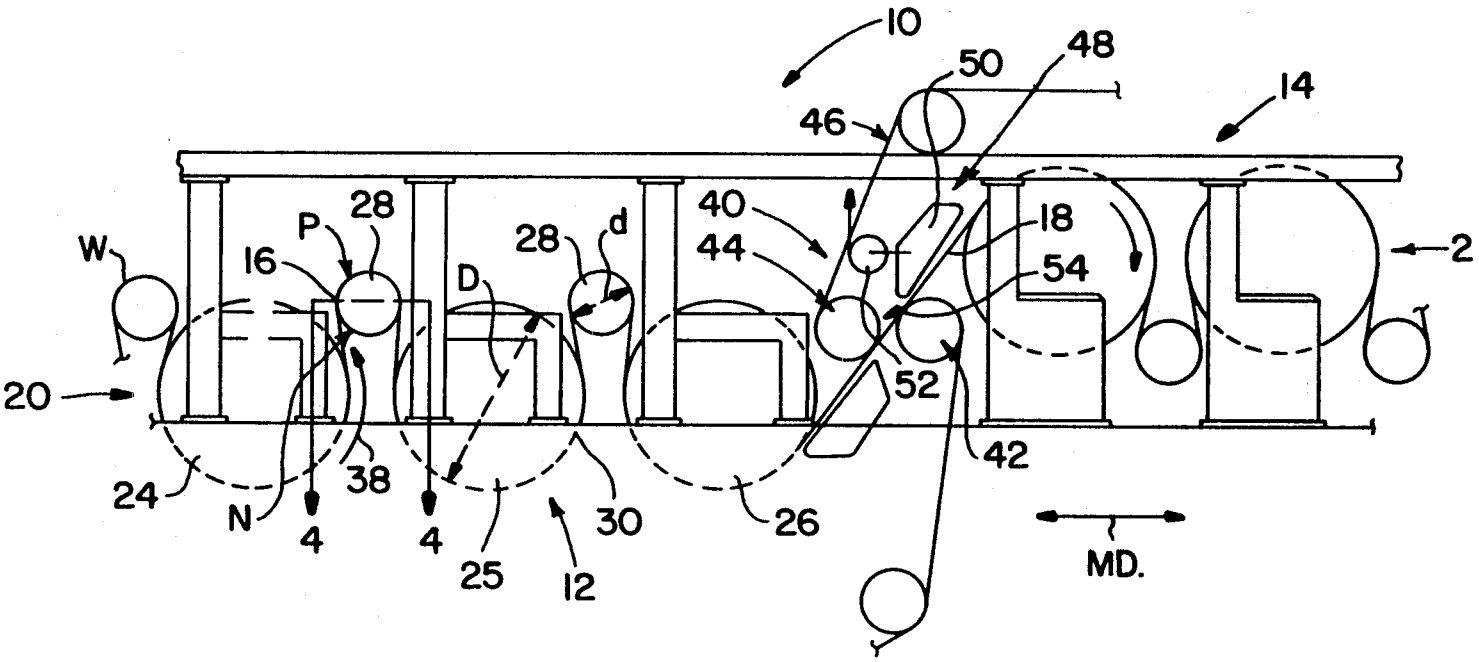
FIG. 1 is a side-elevational view of a dryer apparatus according to the present invention.

FIG. 1 is a side-elevational view of a dryer apparatus generally designated 10 according to the present invention for drying a pressed web W.

The dryer apparatus 10 includes a plurality of single tier dryer sections 12 and 14, respectively, in which successive sections 12 and 14 dry alternate sides 16 and 18 of the web W.

The web W is transferred between successive sections 12, 14 without any open draw of the web W such that the web W is uniformly dried on both sides 16 and 18 thereof while the web W is restrained against cross-machine directional shrinkage.

Each of the dryer sections 12 and 14 includes a single tier of dryers indicated by the arrow 20 and 22, respectively.

More specifically, the dryer section 12 includes a single tier of dryers 24, 25 and 26.

An intermediate roll 28 is disposed between each adjacent dryer 25 and 25 of the single tier of dryers 20.

A dryer felt 30 extends in serpentine configuration around each dryer 24 to 26, and intermediate rolls 28 such that the web W is disposed between the felt 30 and each dryer 24 to 26 of the single tier of dryers 20 for drying one side 16 of the web W.

The felt 30 is also disposed between the intermediate roll 28 and the web W so that the felt 30 is disposed in direct contact with an alternate side 18 of the web W.

Figure 2:
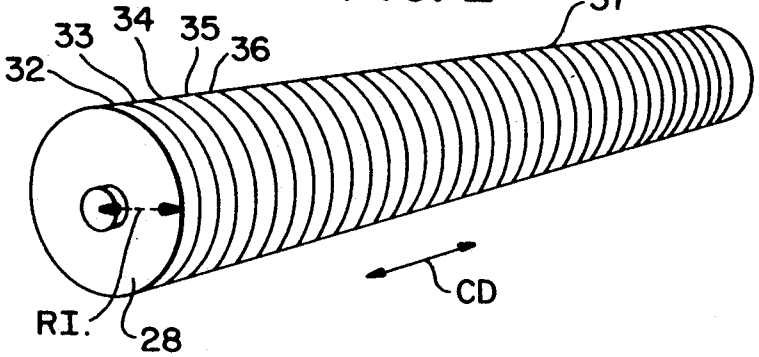
FIG. 2 is a perspective view of an intermediate roll according to the present invention showing a plurality of circumferential grooves defined thereby.
Figure 4:
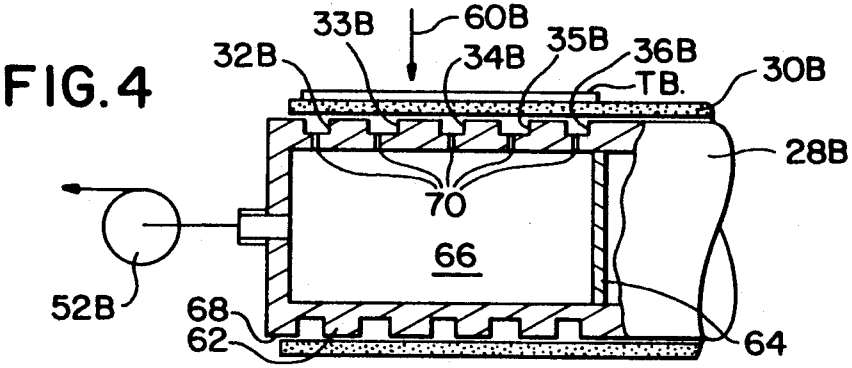
FIG. 4 is a fragmentary sectional view of an alternate embodiment of the present invention showing an intermediate roll including a shell and a baffle defining a tail threading chamber.

The intermediate roll 28 defines a plurality of circumferential grooves as shown more clearly in FIG. 2 which is a perspective view of one of the intermediate rolls 28.

As shown in FIG. 2, the intermediate roll 28 defines a plurality of circumferential grooves 32, 33, 34, 35, 36 and 37 for diffusing boundary air as indicated by the arrows 38 following the felt 30 as shown in FIG. 1 that would otherwise tend to lift the web W from the felt 30 extending around the intermediate roll 28.

The arrangement is such that inherent machine directional shrinkage, as indicated by the arrow MD, during drying thereof inhibits cross-machine directional shrinkage, as indicated by the arrow CD, during movement of the web W between successive dryers 24 and 25.

More specifically, with reference to FIG. 1, the dryer apparatus 10 includes a first single tier dryer section 12 for drying the one side 16 of the web W.

A second single tier dryer section 14 is disposed immediately downstream relative to the first dryer section 12 for drying the alternate side 18 of the web W.

Transfer means generally designated 40 is disposed between the first and the second dryer sections 12 and 14 respectively for transferring the web W without open draw between the first and the second dryer sections 12 and 14.

More specifically, the transfer means 40 includes a felt roll 42 which is disposed between the first and second dryer sections 12 and 14 such that the dryer felt 30 extends from the first dryer section 12 to and around the felt roll 42. The felt 30 is disposed between the felt roll 42 and the web W.

A further felt roll 44 is disposed between the felt roll 42 and the first dryer section 12.

Also, a further felt 46 extends around the further felt roll 44 such that the further felt 46 is disposed between the further felt roll 44 and the web W. The further felt 46 thereafter extends around the second dryer section 12 so that the web W disposed between the felt 30 and the further felt 46 is guided without open draw from the first dryer section 12 to the second dryer section 14.

More particularly, as shown in FIG. 1, means 48 is disposed adjacent to the felt roll 42 for urging the web W to follow the further felt 46 when the felt 30 and the further felt 46 diverge relative to each other adjacent to the felt roll 42.

As shown in FIG. 1, the means 48 is a blow box 50 which is disposed on the opposite side of the further felt 46 relative to the web W. The blow box 50 is connected to a source of pressurized air 52 such that a curtain of air indicated by the arrow 54 is blown from the blow box 50 onto the further felt 46 so that the web W is drawn towards the further felt 46 due to a Coanda effect of the curtain of air 54 relative to the further felt 46.

As clearly shown in FIG. 1, each of the intermediate rolls 28 has a diameter d which is substantially less than the diameter D of adjacent dryers 24 to 26 such that the machine directional shrinkage MD increases the tension of the web W between successive dryers 24 and 25 so that the pressure, as represented by the letter P, exerted by the web W against the dryer felt 30 during movement of the web W around the intermediate roll 28 is increased in conformity with the equation $PS=TW/RI$ pounds per square inch, where PS is the pressure exerted by the web W on the dryer felt 30 extending around the intermediate roll 28, TW is the machine direction tension of the web W induced by the machine directional shrinkage of the web W during drying, and RI is the radius of the intermediate roll 28.

FIG. 2 shows in more detail the intermediate roll 28 which defines a plurality of circumferential grooves 32 to 37. The grooves are spaced in a cross-machine direction CD along the entire length of the roll 28.

As shown in FIG. 2, each groove of the plurality of grooves 32 to 37 extends around the circumference of the roll 28 so that air 38 pumped into each groove by the dryer felt 30 converging relative to the roll 28 flows through and around each groove so that a build-up of air pressure at a converging nip N defined between the dryer felt 30 and the intermediate roll 28 is inhibited.

Figure 3:
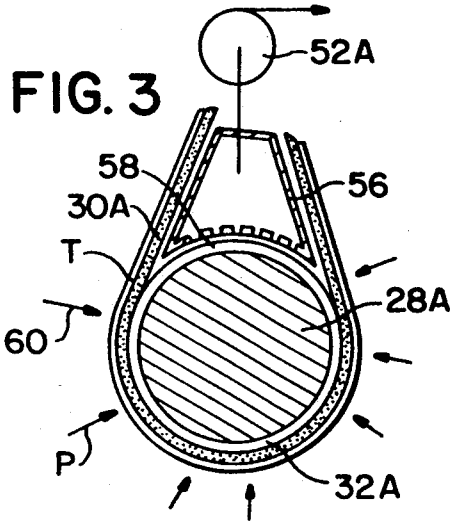
FIG. 3 is a fragmentary sectional view of one embodiment of the present invention showing a portion of an intermediate roll together with an adjacent vacuum box.

FIG. 3 shows an alternative embodiment of the present invention in which a vacuum box 56 is disposed closely adjacent to an unfelted end portion 58 of the intermediate roll 28. The vacuum box 56 is selectively connected to a source of partial vacuum 52A such that in use of the apparatus, during a tail threading operation thereof, the vacuum box 56 is connected to the source of partial vacuum 52A such that air 60 flows in a direction from a tail T of the web W towards and through the dryer felt 30A and into the circumferential groove 32A disposed adjacent to the vacuum box 56 into the vacuum box 56 such that the tail T is urged into close conformity with the dryer felt moving around the intermediate roll 28A during the tail threading operation.

In an alternative embodiment of the present invention, the intermediate roll 28B is a shell roll with the shell defining a plurality of grooves 32B,33B,34B,35B, and 36B and includes a rotatable shell 62 and an internal baffle 64 disposed within the shell 62. The shell 62 and the baffle 64 define a tail threading chamber 66 disposed adjacent to one end 68 of the intermediate roll 28B.

Circumferential grooves 32B to 36B disposed in the vicinity of the tail threading chamber 66 define aperture means 70 such that the tail threading chamber 66 is disposed in fluid communication with the circumferential grooves 32B to 36B disposed in the vicinity of the chamber 66.

The arrangement is such that when the tail threading chamber 66 is connected to a source of partial vacuum 52B, air 60B flows from a tail TB of the web web towards and through the dryer felt 30B, through the grooves 32B to 36B disposed in the vicinity of the threading chamber 66, and through the aperture means 70 into the threading chamber 66 so that the tail TB is urged into close conformity with the dryer felt 30B during a tail threading operation of the dryer apparatus.

In operation of the apparatus according to the present invention, machine directional shrinkage of the web as the web dries increases the pressure exerted by the web against the felt during movement of the web and felt around each intermediate roll so that cross-machine directional shrinkage of the web is inhibited throughout the drying operation.

More specifically, in the prior art single tier dryer sections, special vacuum rolls are utilized to improve sheet runnability and sheet restraint and in some cases to provide the ability to thread the dryer section without the use of rope threading devices.

Such prior art configurations, as disclosed in U.S. Pat. No. 4,934,067, have been shown commercially to be an effective design to achieve the aforementioned objectives.

However, a primary disadvantage of the aforementioned design of U.S. Pat. No. 4,934,067 is the high cost of vacuum rolls and the need for a vacuum system for such rolls.

The present invention overcomes the aforementioned problem by the provision of special felt rolls which replace the aforementioned intermediate vacuum rolls. Such special felt rolls require no internal center shaft, internal seals, and extensive drilled through holes which are required in the prior art vacuum rolls. Specifically, these special felt rolls have grooved surfaces to help diffuse boundary layer air which follows the inside surface of the dryer felt. The single tier dryer section arrangement according to the present invention is further characterized by having the single tier concept extending beyond the wet end of the dryer section into the dry end portion without the need for the aforementioned costly vacuum rolls.

One of the novel features of the present invention resides in the recognition that the basic geometry of the single tier dryer section can have a significant and perhaps controlling influence on the shrinkage restraint which is applied to the web, in some cases without the use of an intermediate vacuum roll.

The following includes an analysis which highlights the essential features of the inventive concept according to the present invention.

The web is restrained in the entire apparatus according to U.S. Pat. No. 4,934,067 by a combination of felt pressure on the web as it passes over the dryers, and the vacuum restraint applied by the vacuum rolls as the web passes around the vacuum rolls. Such combination of restraint mechanisms has proven to be effective on lightweight grades at high machine speeds.

The frictional contact developed between the web and the felt and dryer in the first case and between the web and the felt in the second case inhibits the web from contracting in the cross-machine direction. Such is distinctly different from the more common two-tier dryer section arrangements in which the web experiences very little cross-machine directional restraint in the open draws between dryer cylinders.

In the first case, the pressure applied to the web is given by the equation $P1=T/RD$, pounds per square inch, in which T represents the effective tension in the felt in pounds per linear inch, and RD represents the radius of the dryer cylinder in inches.

In the second case, the pressure applied to the web is given by the equation $P2=PV$, pounds per square inch, in which PV is the vacuum inside the vacuum roll expressed in pounds per square inch.

The above analysis describes the restraint mechanisms which have been recognized to be operative in the dryer sections according to U.S. Pat. No. 4,934,067 and the various modifications thereof.

However, it has been discovered that the machine directional shrinkage of the sheet also has an effect on cross-machine directional restraint. In the single tier geometry of the present invention, the web is always supported by a felt, and, therefore, does not experience the stretching effects of external flows of air in open draws of the web and will, accordingly, according to the present invention, actually shrink in a machine direction.

Such inherent or natural machine directional shrinkage of the web depends on the formation, furnish and fiber orientation but is typically in the range of 2 to 4 percent. In a typical dryer section with 40 dryers, the sheet length in the dryers at any one time is about 600 foot. The aforementioned 600 foot of web has a natural tendency to shrink in the machine direction by 12 to 24 foot. Such shrinkage in the range of 12 to 24 foot means that the web shrinks on an average between 3.6 and 7.2 inches between successive dryers if there are 40 dryers in the dryer apparatus. The aforementioned shrinkage is largely inhibited by the pressure applied to the web by the tensioned felts as the web wraps the dryer cylinders.

Effectively, the web is held both machine directional ends by the dryer felt as it passes over each intermediate roll. The increased tendency for the web to shrink in a machine direction then translates into an increase in the machine directional web tension. Such web tension then translates into a pressure on the fabric as the web wraps the intermediate roll. Such pressure is given by the equation $PS=TW/RI$, pounds per square inch, in which TW is the machine directional tension induced by the machine directional shrinkage tendency, and RI is the radius of the intermediate vacuum roll.

The pressure PS results in a normal force on the felt which, when coupled with the friction between the felt and the web, will prevent or inhibit cross-machine directional shrinkage.

It has been further noted that the effective web tension TW depends on the amount of natural shrinkage that the web exhibits, as well as any plastic relaxation that may occur. The total web tension may be further reduced by the centrifugal forces that the web must counter as it passes around the intermediate roll.

If DL represents the shrinkage tendency of the web in inches, and "e" represents the amount of relaxation of the web, expressed in inches, and if "E" represents the effective modulus of the web, expressed in pounds per square inch, then the total tension developed in the web between cylinders would be $Tt=(DL-e)\ E$, pounds per linear inch.

The loss in effective tension as applied by the web to the dryer felt due to centrifugal forces can be approximated.

More specifically, for intermediate rolls that have a wrap angle of 180 degrees, the aforementioned approximation is represented by the equation $T1=C(B\ n\ RI)\ V^2/RI$, pounds per linear inch, where B is the wet weight of the web expressed in pounds per square foot, and V is the velocity of the web expressed in feet per minute, and RI is the radius of the intermediate roll expressed in inches.

It is to be noted that n equals 3.1415, and that C is an appropriate conversion factor.

Consequently, it has been noted that the loss in tension due to the centrifugal force does not depend on the radius of the intermediate roll.

From the above and by combining the above equations, an expression for the pressure applied by the web to the fabric is:

$$PS = TW / RI$$
$$PS = (Tt - Tl) / RI$$
$$PS = ((DL - e) E - C(B n V^2)) / RI, \text{ pli}$$

From the aforementioned equation, it was discovered that the natural tendency of the web to shrink in a machine direction can be utilized for inhibiting cross-machine directional shrinkage by generating pressure on the dryer felt, and that this inhibition of cross-machine directional shrinkage will be larger for the following conditions:

1) Small diameter intermediate roll (small RI)
2) Low speed machines (low V)
3) Minimum web relaxation (small e)
4) High wet web modulus (high E)
5) High natural machine directional shrinkage rates (high DL)

It has also been observed that the relaxation of the web stress (e) is a time related phenomenon. In other words, there will be less relaxation if the time is short. For a given machine speed, such will be achieved with a small diameter intermediate roll, with short felt tangent lengths between the dryers and associated intermediate rolls.

Accordingly, the present invention has particular application to the manufacture of linerboard and other board at speeds less than 3,000 feet per minute.

The present invention provides a no-draw dryer apparatus for uniformly drying both sides of a web which utilizes machine directional shrinkage to inhibit cross-machine directional shrinkage of the resultant web.

What is claimed is:

1. A dryer apparatus for drying a pressed web, said apparatus comprising:

a plurality of single tier dryer sections in which successive sections dry alternate sides of the web, the web being transferred between successive sections without any open draw of the web such that the web is uniformly dried on both sides thereof while the web is restrained against cross-machine directional shrinkage;

each of said dryer sections including;

a single tier of dryers;

an intermediate roll disposed between each adjacent dryer of said single tier of dryers;

a dryer felt extending in serpentine configuration around each dryer and intermediate roll such that the web is disposed between said felt and each dryer of said single tier of dryers for drying one side of the web, said felt being disposed between said intermediate roll and the web so that said felt is disposed in direct contact with an alternate side of the web;

said intermediate roll defining a plurality of circumferential grooves for diffusing boundary air following said felt that would otherwise tend to lift the web from said felt extending around said intermediate roll, the arrangement being such that inherent machine directional shrinkage of the web during drying thereof inhibits cross-machine directional shrinkage of the web during movement of the web between successive dryers;

said dryer apparatus further including:

a first single tier dryer section for drying said one side of the web;

a second single tier dryer section disposed immediately downstream relative to said first dryer section for drying said alternate side of the web;

transfer means disposed between said first and second dryer sections for transferring the web without open draw between said first and second dryer sections;

said transfer means including;

a felt roll disposed between said first and second dryer sections such that said dryer felt extends from said first dryer section to and around said felt roll, said felt being disposed between said felt roll and the web;

a further felt roll disposed between said felt roll and said first dryer section;

a further felt extending around said further felt roll such that said further felt is disposed between said further felt roll and the web, said further felt thereafter extending around said second dryer section so that the web disposed between said felt and said further felt is guided without open draw from said first to said second dryer section; and means disposed adjacent to said felt roll for urging the web to follow said further felt when said felt and said further felt diverge relative to each other adjacent to said felt roll.

2. A dryer apparatus as set forth in claim 1 wherein said means is a blow box disposed on the opposite side of said further felt relative to the web, said blow box being connected to a source of pressurized air such that a curtain of air is blown from said blow box onto said further felt so that the web is drawn towards said further felt due to a Coanda effect of said curtain of air relative to said further felt.

3. A dryer apparatus for drying a pressed web, said apparatus comprising:

a plurality of single tier dryer sections in which successive sections dry alternate sides of the web, the web being transferred between successive sections without any open draw of the web such that the web is uniformly dried on both sides thereof while the web is restrained against cross-machine directional shrinkage;

each of said dryer sections including:

a single tier of dryers;

an intermediate roll disposed between each adjacent dryer of said single tier of dryers;

a dryer felt extending in serpentine configuration around each dryer and intermediate roll such that the web is disposed between said felt and each dryer of said single tier of dryers for drying one side of the web, said felt being disposed between said intermediate roll and the web so that said felt is disposed in direct contact with an alternate side of the web;

said intermediate roll defining a plurality of circumferential grooves for diffusing boundary air following said felt that would otherwise tend to lift the web from said felt extending around said intermediate roll, the arrangement being such that inherent machine directional shrinkage of the web during drying thereof inhibits cross-machine directional shrinkage of the web during movement of the web between successive dryers; and a vacuum box disposed closely adjacent to an unfelted end portion of said intermediate roll, said vacuum box being selectively connected to a source of partial vacuum such that in use of the apparatus, during a tail threading operation thereof, said vacuum box is connected to said source of partial vacuum such that air flows in a direction from a tail of the web towards and through said dryer felt and into said circumferential grooves disposed adjacent to said vacuum box and into said vacuum box such that said tail is urged into close conformity with said dryer felt moving around said intermediate roll during said tail threading operation.

* * * * *